US006027613A

United States Patent [19]

Steiner et al.

[11] Patent Number: 6,027,613

[45] Date of Patent: Feb. 22, 2000

[54] SUCTION DEVICE WITH RELEASE MECHANISM FOR A FABRIC WEB SECTION OF A PAPER MACHINE

[75] Inventors: Karl Steiner, Herbrechtingen; Hans Prinzing, Heidenheim, both of Germany

[73] Assignee: Voith Sulzer Papiermaschinen GmbH, Heidenheim, Germany

[21] Appl. No.: 08/978,059

[22] Filed: Nov. 25, 1997

[30] Foreign Application Priority Data

Nov. 26, 1996 [DE] Germany ..... 196 48 850

[51] Int. Cl.[7] ..... D21F 1/48

[52] U.S. Cl. ..... 162/252; 162/274; 162/363; 162/364

[58] Field of Search ..... 162/274, 278, 162/279, 363, 364, 374, 252

[56] References Cited

U.S. PATENT DOCUMENTS

| | | | |
|---|---|---|---|
| 1,719,969 | 7/1929 | Dupvis | 162/278 |
| 2,544,572 | 3/1951 | Vickery . | |
| 3,420,736 | 1/1969 | Kwasniewski et al. | 162/374 |
| 3,472,733 | 10/1969 | Holt | 162/364 |
| 3,595,744 | 7/1971 | Skoldkvist | 162/364 |
| 3,841,910 | 10/1974 | Baker | 162/274 |
| 5,489,365 | 2/1996 | Wahlstrom | 162/374 |
| 5,573,644 | 11/1996 | Poikolainen | 162/279 |
| 5,635,032 | 6/1997 | Bubik et al. | 162/301 |

FOREIGN PATENT DOCUMENTS

| | | |
|---|---|---|
| 491274 | 6/1992 | European Pat. Off. . |
| 4305493 | 8/1994 | Germany . |
| 2129026 | 5/1984 | United Kingdom . |

*Primary Examiner*—Karen M. Hastings
*Attorney, Agent, or Firm*—Greenblum & Bernstein, P.L.C.

[57] ABSTRACT

Suction device for use in a machine for producing a sheet and a method to vacuum a web section of a paper machine. The suction device includes a contact surface to place on the web section and a suction box. The suction box is designed to have a vacuum pressure applied to drain the web section. The suction device further includes a control device and a release mechanism or an adjustment mechanism for releasing the suction box from the web section while the vacuum pressure is applied or thereafter so that the web section is guided along the contact surface with less friction and without the web section detaching from the contact device. A method to suction a web section in a paper machine including arranging a contact surface a suction device on the web section and applying a vacuum pressure to the suction device to vacuum the web section. The method further includes operating the paper machine to guide the web section along the contact surface and pressing the web section onto the contact surface by the vacuum pressure. Finally, the method includes releasing the suction device from the web section at the time of or after applying the vacuum pressure thereby guiding the web section along the contact surface with less friction and without the web section detaching from the contact surface.

6 Claims, 3 Drawing Sheets

SUCTION DEVICE WITH RELEASE MECHANISM FOR A FABRIC WEB SECTION OF A PAPER MACHINE

CROSS-REFERENCE TO RELATED APPLICATION

The present application claims priority under 35 U.S.C. §119 of German Patent Application No. 196 48 850.8 filed Nov. 26, 1996, the disclosure of which is expressly incorporated by reference herein in its entirety.

BACKGROUND OF THE INVENTION

1. Field of the Invention

The invention relates to a suction device for a paper machine for producing a paper or cardboard web and a method for vacuuming a web section of a paper machine.

2. Background of the Invention

Suction devices in paper machines are primarily used to vacuum the fabric webs of the paper machine. The fabric webs may be vacuumed either with or without an adhering paper web. One purpose of vacuuming the fabric web is to dehumidify the fabric web and/or the adhering paper web. Such suction devices may also be used to transfer the paper web from one fabric web to another fabric web.

In this context, a "fabric web" typically refers to a felt web or belt. However, the term as used herein shall also encompass forming and drying screens or sieves.

The vacuum pressure that is applied to the suction device creates a normal force between the contact surface of the suction device and the fabric web. This normal force leads to relatively strong friction between the fabric web and the contact surface. Of course, this friction causes considerable wear and tear on the fabric sheet or web and the contact surface.

It is known in the art to reduce the friction by positioning the suction device slightly back from the straight roll-to-roll connection (straight roll connection) within the press unit. The movement or excursion of the fabric web section away from the straight roll connection (due to the suction device) creates a force that acts against the normal force described above, thereby decreasing the friction between the fabric web and the contact surface.

These known suction devices, however, suck air in during their start-up, thus, the felt belt must be placed on the suction device by hand. The need for trained personnel to place the web section on the suction device by hand is labor-intensive and costly.

SUMMARY OF THE INVENTION

The goal of the present invention is to suggest a suction device for a paper machine and a press unit of a paper machine, and a method of applying a vacuum to a web section of a paper machine, which decreases the friction between the contact surface of the suction device and the web section without the need for trained personnel.

To overcome the above-noted problems in the conventional suction devices, the present invention includes a suction device for use in a machine that produces a sheet. The suction device includes a contact surface and a suction box designed to have a vacuum applied to drain the web section. The suction device further includes a control device and a release mechanism. The control device operates the release mechanism so that the suction device is released from the web section while the vacuum pressure is being applied. Thus, the friction between the web section and the contact surface is reduced.

As used herein, "control device" refers to any type of device that enables the release mechanism to reduce the normal force between the contact surface and the web section when vacuum pressure has been applied to the suction device. It should be noted, moreover, that when vacuum pressure has been applied, it is no longer possible for the web section to detach from the contact surface. This safely eliminates the possibility that the suction device vacuums in air and is no longer able to perform its intended function. The reduction in friction produces the additional benefit of allowing the paper machine to use less energy while operating.

Releasing the suction device from the web section when vacuum pressure has been applied causes the decrease in friction without the need to press the web section onto the contact surface of the suction device by hand. As used herein, "release mechanism" refers to any type of mechanism that allows a decrease in the normal force created by the vacuum pressure (and thus, a decrease in the friction) between the contact surface and the web section. In other words, the release mechanism creates a force that acts against the normal force. It is, moreover, understood that the control device that operates the release mechanism may be a part of the overall paper machine control system.

Of course, the invention may be used with a press arrangement or press unit of a paper machine with at least one fabric web. The moisture is pressed from the paper web that is being produced and the suction device is positioned on the web section of the fabric web to drain the fabric web.

Another way to state the invention is a suction device for use in a machine for producing a sheet that includes a contact surface coupled to a web section, the web running in a run direction. The suction device further includes a suction box applying vacuum pressure to suction the web section. The vacuum pressure creates a normal force between the web section and the contact surface. The suction device further includes a release mechanism releasing the suction box from the web section during the application of the vacuum pressure to reduce friction between the web section and the contact surface.

In accordance with one aspect of the invention, the suction device may include a control device to operate the release mechanism to movably position the suction device and the web section.

According to one aspect of the invention, the sheet may be a paper web. Moreover, the web may be a fabric web, including, for example, a felt web or felt belt.

According to another aspect of the invention, the release mechanism, in releasing the suction device from the web section may act upon the suction device in a force-controlled manner.

In this way, it is possible to directly control the amount of force created by the release mechanism that acts against the normal force. The web section detaches from the contact surface when a certain difference between the normal force and the force created by the release mechanism (i.e., the minimal force differential) fails to be attained. Because, in this embodiment, the difference between the normal force and the force created by the release mechanism can be directly controlled, the difference created by the release mechanism can be maximized without allowing the web section to detach from the control surface or without reaching or exceeding the minimal force differential. Thus, very low friction can be achieved and the detachment of the web section from the contact surface can safely be avoided.

In accordance with one aspect of the invention, the release mechanism may be designed or adapted to be an adjustment mechanism to elevate the suction device above the web section by a distance that reduces the friction between the contact surface and the web section without the web section detaching from the contact surface. The control device operates the adjustment mechanism while the vacuum pressure is created in the suction device.

According to one aspect of the invention, the suction device may be elevated a distance in the range of about 0.002 meters to about 1 meter. Preferably, the suction device may be elevated a distance within the range of 0.005 meters to 0.1 meters, with approximately 0.02 meters being one of the most preferable distances.

In this embodiment, the force that acts against the normal force is created by the adjustment mechanism elevating the suction device from the web section that has a straight roll connection.

In accordance with one aspect of the invention, the adjustment mechanism may be created by a mechanism that also elevates the suction device to an elevated position from the web section for maintenance purposes.

Maintenance mechanisms that elevate the suction device to an elevated position from the web section for repairing and/or cleaning the suction device are known. By using such a mechanism for the adjustment mechanism, the paper machine can be constructed more compactly because there need be no additional mechanisms installed. It is only necessary to couple the control device with the already present repair device such that the repair mechanism may be elevated by a certain amount during operation with applied vacuum pressure (to reduce the friction between the web section and the contact surface).

In accordance with yet another aspect of the invention, the adjustment mechanism may be designed such that it holds the suction device in the elevated position by itself or with the assistance of notches designed in the elevated position.

These measures make it unnecessary to direct energy to the adjustment mechanism throughout the entire duration of the operation, thereby reducing the energy consumption of the paper machine.

In accordance with another aspect of the invention, the adjustment mechanism contacts the contact surface on either side of the web section. The adjustment mechanism contacts the suction device on the side of the web section that begins contacting the contact surface and agin contacts the suction device on the side of the web section, in the run direction, that ends contact with the contact surface.

In accordance with one embodiment of the invention, the adjustment mechanism may include a spindle mechanism. The spindle mechanism is advantageous because it can be adeptly controlled, for example, by an electric motor, and because a spindle mechanism is able to maintain an elevated position by itself Alternatively, it is also possible, in accordance with the present invention, to design a hydraulic or pneumatic piston/cylinder arrangement for the adjustment mechanism. Such devices could also maintain or hold an elevated position by switching a valve.

Further, the contact surface may be provided with a concave curvature. The concave camber/swell compensates for the convex deflection of the fabric web section. The deflection of the web section is created because the adjustment mechanism touches the suction device on both sides of the web section and the suction device, due to the vacuum pressure, creates the normal force.

In accordance with one aspect of the invention, the control device operates the release mechanism depending on the operating parameters of the paper machine.

By way of nonlimiting example only, these parameters may include the fabric web tension, the differential pressure on the suction device, the type of fabric web, the fabric web run time or the suction device length.

In accordance with another embodiment of the invention, the release mechanism may include a pressure-driven bellows arrangement.

The pressure-driven bellows arrangement makes it unnecessary to design a separate power source for the release mechanism because the vacuum pressure is already provided for the suction device.

Thus, it is useful to have the bellows arrangement contact the suction device on the side that faces away from the contact surface and to have the bellows arrangement powered by the vacuum pressure that is also applied to the suction device. This arrangement is advantageous because the force used by the bellows arrangement to elevate the suction device above the web section and the force applied by the vacuum of the operate in tandem. In other words, the greater the force used by the bellows arrangement, the greater the force applied by the vacuum.

In accordance with another aspect of the invention, the bellows arrangement may be powered by a vacuum source that is independent of the vacuum source applied to the suction device.

The bellows arrangement is further advantageous because it may include a row of single bellows that may be spaced substantially perpendicular to the web run direction. Thus, the force exerted by the bellows arrangement on the suction device is evenly spaced over the length of the suction device. This arrangement avoids the deflection of the suction device from its position substantially perpendicular to the web run direction. Accordingly, a consistent suction is achieved over the width of the web section. The row of single bellows may be powered by a vacuum source that is independent of the vacuum source applied to the suction device of by the same vacuum source that is applied to the suction device.

According to another aspect of the invention, the contact surface may include two suction strips forming a suction opening. The suction strips may be inclined toward each other at a certain angle.

The angle may be within the approximate range of about 1° to about 40°. Preferably, the angle may be within a range of about 3° to about 20°, with about 10° being one of the more preferred angles.

Elevating the suction device from the web section causes that part of the web section that leads into the suction device to be inclined at an obtuse angle to that part of the web section that leads away from or exits the suction device. Inclining the suction strips toward each other at a corresponding angle causes the corresponding parts of the web section to each rest flat on the respective suction strips. Thus, the normal force created by the vacuum pressure is spaced over a larger surface, leading to less friction overall.

According to another aspect of the invention, the contact surface may include two suction strips which form a suction opening. In accordance with yet another aspect of the invention, the outer edges of the suction strips may be rounded. Rounding the edges is particularly advantageous when the suction strips are inclined toward each other at an angle, because, in the non-elevated position, the suction strips touch or contact the web section with their outer edges. Rounding the edges avoids the danger of damaging the web section.

According to another aspect of the invention, the contact surface includes two suction strips forming a suction opening between them. The suction strips further include a curvature that is concave with respect to the web section. The concave curvature makes it possible to position the suction device directly adjacent a web section that loops around a roll of the paper machine. It should be noted that, preferably, the concave curvature should be tailored to the radius of the roll.

In accordance with another aspect of the invention, the suction device may be arranged adjacent to at least one fabric web to drain at least one fabric web by pressing moisture from the paper web into the at least one fabric web.

In accordance with yet another aspect of the invention, the suction device may be adapted for use in combination with a press unit of the machine for producing the sheet.

The suction device may be positioned to drain at least one fabric web.

Another way to state the invention is a suction device for use in a machine for producing a sheet that includes a contact surface to place adjacent a web section and a suction box adapted to have a vacuum pressure applied to drain the web section. The suction device may further include a control device and a release mechanism releasing the suction box from the web section while the vacuum pressure is applied while the web section is guided along the contact surface, thereby reducing the friction between the web section and the contact surface.

As before, the sheet may be a paper web and the web may be a fabric web or a felt belt.

In accordance with another aspect of the invention, the release mechanism may be adapted to release the suction device from the web section in response to a force created by the vacuum pressure applied to drain the web section. The release mechanism may further be adapted to adjust the suction device by elevating the suction device above the web section by a distance to reduce the friction between the contact surface and the web section without detaching the web section from the control surface.

The adjustment mechanism may include a lever for elevating the suction device from the web section for maintenance of the suction device. Further, the adjustment mechanism may include notches to hold the suction device in the elevated position.

According to yet another aspect of the invention, the control device may operate the release mechanism in response to web tension, or in response to the differential pressures on the suction device.

In accordance with one aspect of the invention, the release mechanism may be driven by at least one spindle arrangement or at least one bellows arrangement or at least one pistoncylinder arrangement.

The present invention further includes a method of vacuuming a web section in a paper machine. The method includes arranging a contact surface of a suction device on the web section and applying a vacuum pressure to the suction device to vacuum the web section and to press the web section onto the contact surface by the vacuum pressure. The method further includes operating the paper machine to guide the web section along the contact surface and releasing the suction device from the web section at the time of or after applying the vacuum pressure. Thus, the web section is guided along the contact surface with less friction and without the web section detaching from the contact surface.

Another way of stating the invention is a method to suction a web section of a machine for producing a sheet including arranging a contact surface of a suction device adjacent the web section. The method further includes applying a vacuum pressure to the suction device to suction the web section and to press the web section onto the contact surface by vacuum pressure. The method further includes guiding the web section along the contact surface and decreasing the friction between the contact surface and the web section while the web section adheres to the contact surface by releasing the suction device from the web section.

According to one aspect on the invention, the sheet may be a paper web. Moreover, the web may be at least one fabric web or at least one felt belt.

It is understood that the features discussed above and below may be used, not only in the combinations given, but also in other combinations or alone, without departing from the scope of the invention.

Other useful embodiments and advantages of the present invention may be ascertained by reviewing the present disclosure and the accompanying drawings.

BRIEF DESCRIPTION OF THE DRAWINGS

The invention will be better understood by referring to the description which follows with reference to the drawing, which illustrates by way of non-limiting example, embodiments of the invention, wherein.

DETAILED DESCRIPTION OF THE DRAWINGS

Figure 1:
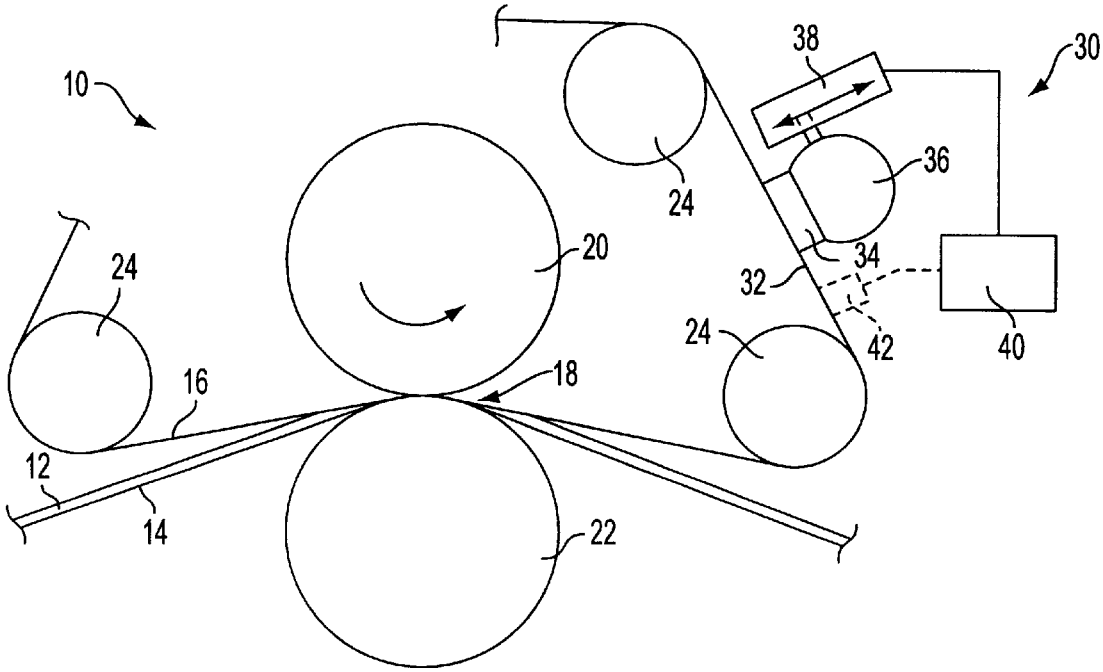
FIG. 1 is a schematic side view of a section of a press unit of a paper machine with a suction device.

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing figure making apparent to those skilled in the art how the invention may be embodied in practice FIG. 1 diagrams a segment of a press section 10 of a paper machine. In this particular segment of the press section 10, a paper web 12 is guided between a lower felt belt 14 and an upper felt belt 16 into a press opening 18. The press opening or slit 18 is created by two press rolls 20, 22.

The paper web 12 runs into the press opening or slit 18 on the lower felt belt (sieve or screen) 14. On the exit side of the press opening 18, the upper felt belt (sieve or screen) 16 is guided around a row of felt guide rolls 24. In the press opening 18, any moisture present in the paper sheet is pressed into the felts 14, 16 by means of the press rolls 20, 22. To drain the upper felt belt 16, the upper felt belt 16 is guided around two felt guide rolls 24 which are placed on the exit side of the press opening 18. A suction device 30 is positioned between the two felt guide rolls 24.

The suction device 30 includes a contact surface 34. As FIG. 1 shows, the contact surface 34 may be located on or adjacent the web section 32 of the upper felt belt 16 between the two felt guide rolls 24. A suction box 36, upon which vacuum pressure can be applied, may be located above the contact surface 34.

The contact surface 34 and the suction box 36 of the suction device 30 may be conventional in the art and it is unnecessary to present a detailed description of them here.

However, in contrast to the conventional suction devices, the present invention includes a release mechanism 38 that is designed to be operated by a control device 40.

Generally, the release mechanism 38 operates by exerting a force on the arrangement of the suction box 36 and the web section 32 is contacting the contact surface 34. The force that is created by the release mechanism 38 acts against a normal force, which is created by the vacuum applied to the suction box 36. The normal force presses the web section 32 against the contact surface 34. The opposing force created by the release mechanism 38 effectively produces a lesser resultant force acting between the web section 32 and the contact surface 34. Thus, the friction between the web section 32 and the contact surface 34 is reduced. The release of the suction device 30 from the web section 32 reduces wear and tear on both the felt belt 16 and the contact surface 34.

One of the definitive influences of the release mechanism 38 is the force created to act against the normal force created by the vacuum pressure. Generally, it is necessary to elevate the suction device 30 from the web section. The elevation may occur either vertically from the run direction of the web or obliquely to the run direction of the web. It may also be possible, moreover, to release the suction device 30 from the web section 32 by applying a piston force, for example, where the suction device 30 is not significantly elevated from the web section 32.

According to the embodiment as shown in FIG. 1, the present invention further includes a sensor 42 connected to the control device 40. The sensor 42 detects web tension. This configuration makes it possible to regulate the release of the suction device 30 from the web section 32 by measuring web tension. It is also possible to control or regulate the release mechanism 38 by measuring or detecting other operating parameters. These operating parameters can, for example, be the type of felt used, the felt run time, the length of the suction device or the differential pressure on the suction device.

The control device 40 may be either a separate, decentralized control device or may be part of a central paper machine control system (not illustrated).

Figure 2:
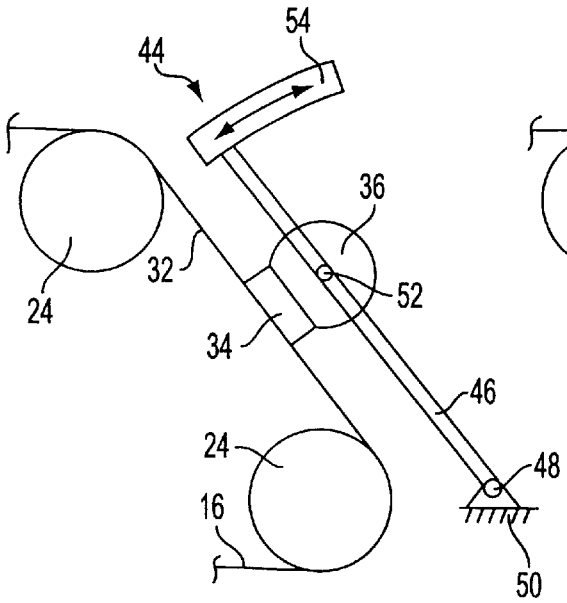
FIG. 2 is a schematic drawing of an embodiment of the suction device from FIG. 1 in a non-elevated position relative to the web section.
Figure 3:
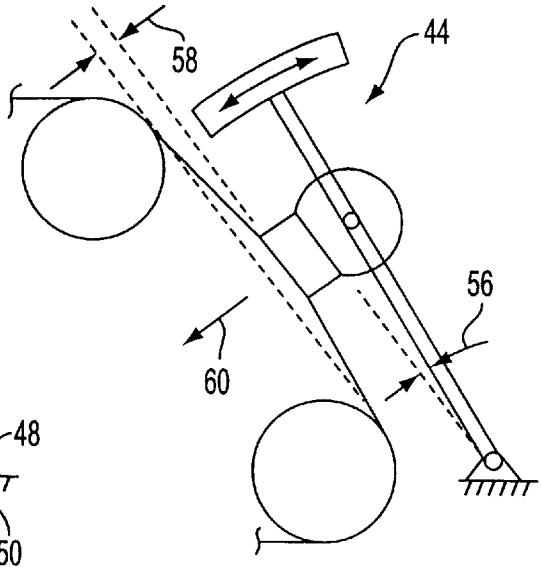
FIG. 3 is a schematic drawing of the suction device from FIG. 2 in an elevated position relative to the web section.

As shown in FIG. 2 and FIG. 3, according to one embodiment of the invention, the release mechanism 38 is designed to be an adjustment mechanism 44. The adjustment mechanism 44 includes a lever 46 which is mounted in a pivotable fashion on a fulcrum 48. The fulcrum 48 is placed on the stationary support SO of the paper machine. A middle part of the lever 46 is connected to the suction box 36 by a second fulcrum 52. The free end of the lever 46 is coupled to a motor 54 that allows the lever 46 to swivel around the fulcrum 48. The motor 54 may be connected with the control device 40 (not shown in FIG. 2 and 3).

Before applying vacuum pressure to the suction box 36 of the suction device 30, the lever 46 is positioned to allow the contact surface 34 of the suction device 30 to rest against the web section 32, creating a straight roll connection during the web section 32. While the vacuum pressure is applied, the lever 46 pivots around an angle 56.

The angle 56 may range from about 1° to about 40°. Preferably, the angle 56 is within the range of about 3° to about 20°, with approximately 10° being one of the more preferred angles 56. It should be noted that the angle 56 may be influenced by the placement of the suction device 30 on the web section 32.

As the lever 46 pivots, it moves the suction device 30 with it. Even though the suction device 30 moves, the web section 32 does not detach itself from the contact surface 34 because of the vacuum pressure. Thus, in the end, the web section 32 moves by a certain distance 58.

The distance 58 may be within the range of approximately 0.002 meters to approximately 1 meter. Further, according to one embodiment, it may be preferable for the distance 58 to be within the range of approximately 0.005 meters to approximately 0.1 meters. In accordance with one embodiment, it may be preferable to have the distance 58 be approximately 0.02 meters. It should be noted that the distance 58 that is most preferable for a given arrangement may be influenced by the space or distance between the rolls 24 in the roll-to-roll connection. It should further be noted that the range of feasible distances 58 corresponds to the range of feasible angles 56.

The tensile stress created by the excursion or movement of the web section 32 creates a force 60. This force 60 acts against the normal force that is created by the vacuum pressure that presses the web section 32 against the contact surface 34. The force 60, thus, acts to decrease the friction between the web section 32 and the contact surface 34, leading, overall, to less wear and tear on the upper felt belt 16 and to less energy being consumed by the paper machine.

It is possible to design the lever 46 of the adjustment mechanism 44 such that the lever 46 is part of a usual maintenance mechanism that is already present in many paper machines. Specifically, the lever 46 may simultaneously be the means by which the suction device is elevated from the web section 32 for repair or cleaning when the paper machine 10 is not operating. In this case, only a motor 54 with a suitably programmed control device 40 must be provided to completely provide the adjustment mechanism 44 of the suction device 30.

Figure 4:
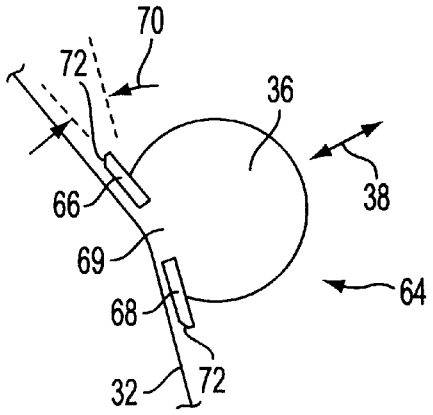
FIG. 4 is a schematic drawing of another embodiment of a suction device.

FIG. 4 shows one embodiment of the suction device 64. In FIG. 4, the release mechanism 38 is only roughly shown.

The suction device 64 includes two suction strips 66, 68 which are symmetrically positioned in the web run direction. The two suction strips 66, 68, create a suction opening 69. The suction strips 66, 68 are inclined away from one another at an angle 70. Moreover, each of the outer edges 72 of the suction strips 66, 68 is rounded.

The angle 70 may be within the approximate range of 1° to 40°. Preferably, the angle 70 is approximately within the range of 3° to 20°, with approximately 10° being the most preferable angle.

When the suction device 64 is elevated, the angled position of the two suction strips 66, 68 allows the part of the web section 32 that runs toward the suction device 64 and the part of the web section 32 that leads away from the suction device 64 to be positioned parallel to the suction strips 66, 68. Thus, the flat arrangement between the suction strips 66, 68 and the web section 32 decreases the friction between the suction strips 66, 68 and the web section 32.

When the suction device 64 is not elevated, the web section 32 contacts only the outer edges 72 of the suction strips 66, 68. The rounded edges of the outer edges 72 avoids damage to the web section 32 when the suction device 64 is not elevated.

Figure 5:
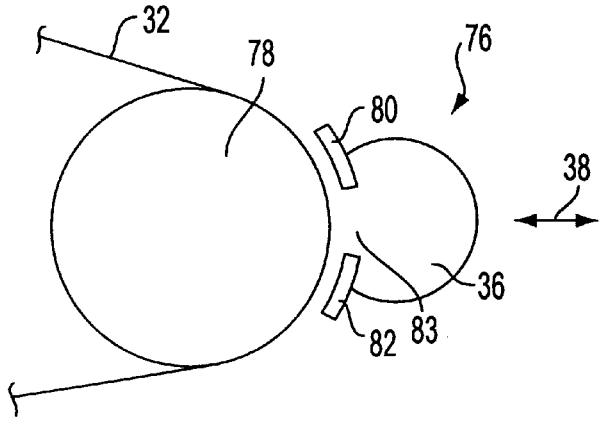
FIG. 5 is a schematic drawing of an embodiment of a suction device for use on a web section on a roll.

FIG. 5 shows another embodiment of a suction device 76. Again, for purposes of this discussion, the release mechanism 38 is indicated merely schematically. The contact surface of the suction device 76 includes two suction strips 80, 82 that form a suction opening 83. The lower side of the suction strips 80, 82 is concave, with a radius that corresponds to the radius of a ventilated roll 78. As shown in FIG. 5, in this embodiment of the present invention, the web section 32 loops around a ventilated roll 78. Thus, the suction device 76 is particularly suited for vacuuming web sections that loop around rollers.

Figure 6:
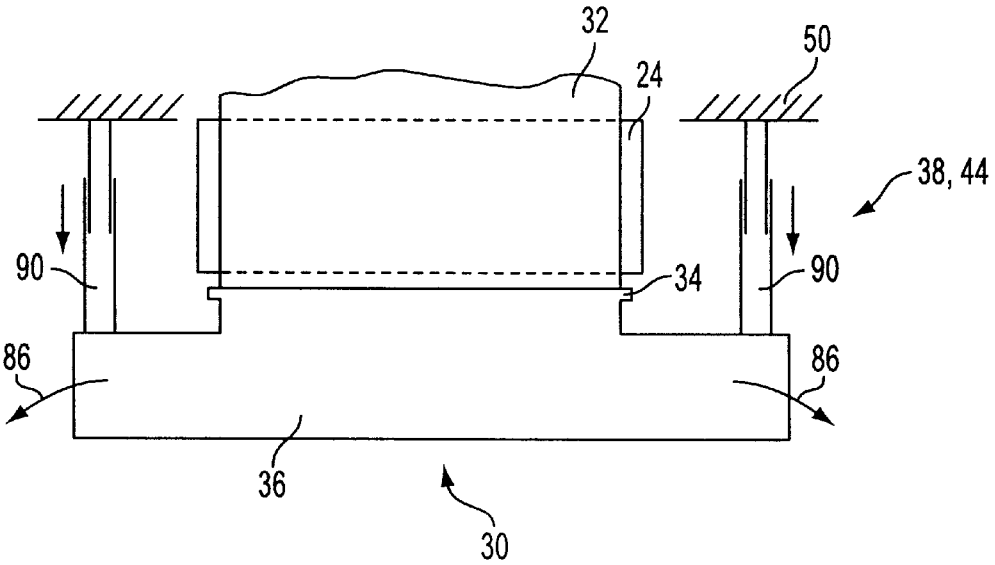
FIG. 6 is a top view of an embodiment of a suction device.
Figure 7:
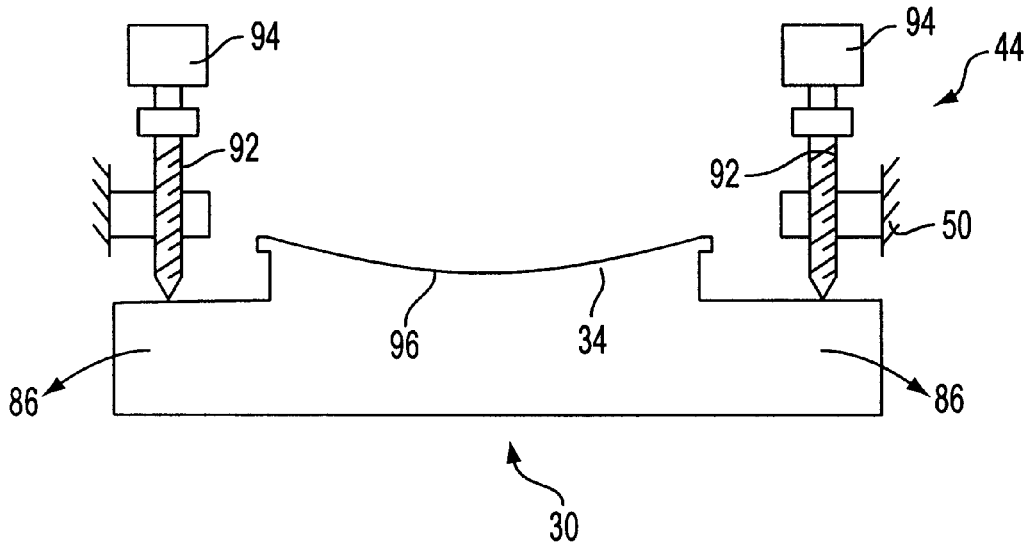
FIG. 7 is top view of an embodiment of a suction device.
Figure 8:
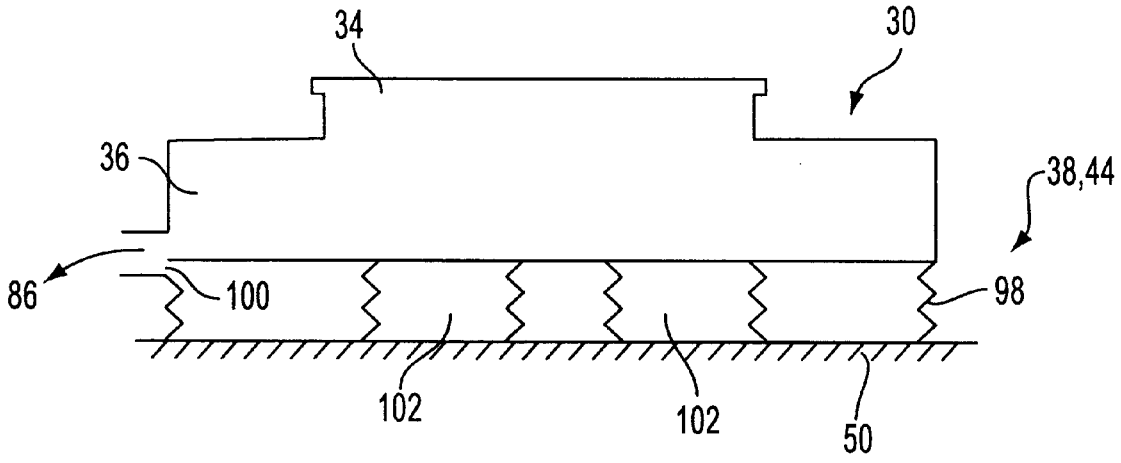
FIG. 8 is a top view of an embodiment of a suction device.

FIG. 6, FIG. 7 and FIG. 8 show three different embodiments of release mechanisms 38 or adjustment mechanisms 44.

In FIG. 6, FIG. 7 and FIG. 8, arrows 86 indicate the air leaving the suction box 36 of the suction device 30 when the vacuum pressure is created in the suction device 30.

In the embodiment as shown in FIG. 6, the release mechanism 38 includes two piston/cylinder arrangements 90 which contact the suction box 36 on either side of the web section 32 that is between the two rolls 24.

FIG. 7 shows another embodiment of the invention, wherein the adjustment mechanism 44 includes two spindle arrangements 92. The two spindle arrangements 92 contact the suction device 30 on either side of the web section 32 (not shown in FIG. 7). The spindle mechanisms 92 are each coupled with a motor (not shown in FIG. 7).

As shown in FIG. 7, according to one embodiment of the invention, the contact surface 34 of the suction device 30 may include a curved surface or curvature 96 that curves away from the web section 32. The contacting of the spindle mechanisms 92 on either side of the web section 32 causes the suction device 30 to bend when vacuum pressure 86 is applied. When the suction device 32 is elevated, this bending is compensated for by the curvature 96, which ensures that the contact surface 34 is placed flat against the web section 32. The curvature 96 is shown in an exaggerated manner in FIG. 7 for display purposes.

As shown in FIG. 8, one embodiment of the invention includes a release mechanism 38 that includes a bellows arrangement 98. The bellows arrangement 98 is positioned between the suction box 36 of the suction device 30 and the stationary support SO of the paper machine 10 on the side of the suction device that is opposite the contact surface 34.

To elevate the suction device 30 above the web section 32 (not illustrated in FIG. 8), the bellows arrangement 98 may be powered or actuated by vacuum pressure. To obtain the vacuum pressure, the bellows arrangement 98 is connected, by channel 100, with the vacuum pressure that is applied to the suction device 30 to vacuum the web section 32 (as represented by arrows 86). Thus, the force that is exerted on the suction device 30 by the bellows arrangement 98 is directly dependent on the magnitude of the vacuum pressure 86 applied to the suction device 30. This embodiment is advantageous in that it does not require any special control device 40. Rather, the control of the bellows arrangement 98 automatically occurs because the bellows arrangement is connected to the vacuum pressure 86 by channel 100.

If there is no vacuum pressure 86, the bellows arrangement 98 is at rest and the contact surface 34 rests against the web section 32, creating a straight roll connection. As soon as vacuum pressure 86 is applied, the suction device 30 is increasingly elevated above the straight roll connection as the vacuum pressure 86 increases, thus creating a force that acts in the opposite direction to the normal force that is created by the vacuum pressure 86 between the contact surface 34 and the web section 32. This newly created force is directly proportional to the normal force. If no direct proportionality is desired, a control device 40 may be included in this embodiment. The control device 40 will independently control the bellows arrangement 98 by contacting channel 100.

To ensure the even distribution of the force exerted by the bellows arrangement 98, it may be useful to design a row of single bellows 102, spaced over the length of the suction device 30. FIG. 8 briefly shows these elements (in sketch form only).

One skilled in the art will know that, instead of a mechanism (as shown in either FIG. 6 or FIG. 7) that contacts the suction device 30 on either side of the web section 32, a mechanism may be designed which contacts the suction device 30 evenly along the length of the web section 32 to avoid deflections. If this were the case, it would be unnecessary to design a contact surface with a curvature 96, as shown in FIG. 7.

The embodiments shown and described are for illustrative purposes only and are not intended to limit the scope of the invention as defined by the claims. While the preferred embodiments of the invention have been illustrated and described, the present invention is not limited by the preferred embodiments as described and illustrated above. Various changes can be made therein without departing from the spirit and scope of the invention.

What is claimed is:

1. A suction device for use in a machine for producing a sheet comprising:

a contact surface coupled to a web section, the web running in a run direction;

a suction box applying vacuum pressure to suction the web section, the vacuum pressure creating a normal force between the web section and the contact surface;

a release mechanism releasing the suction box from the web section during the application of the vacuum pressure to reduce friction between the web section and the contact surface;

a control device to operate the release mechanism to movably position the suction device and the web section and operating the release mechanism in response to an operating parameter of the machine, the operating parameter comprising a parameter selected from at least one of web tension, type of felt used, felt run time, length of the suction device and the differential pressure on the suction device; and the release mechanism designed to be an adjustment mechanism elevating the suction device to an elevated position above the web section by a distance reducing the friction between the contact surface and the web section without the web section detaching from the contact surface; the control device operating the adjustment mechanism while vacuum pressure is created in the suction device.

2. The suction device according to claim 1, wherein the operating parameter comprises web tension.

3. The suction device according to claim 1 , wherein the operating parameter comprises type of felt used.

4. The suction device according to claim 1, wherein the operating parameter comprises felt run time.

5. The suction device according to claim 1, wherein the operating parameter comprises length of the suction device.

6. The suction device according to claim 1, wherein the operating parameter comprises the differential pressure on the suction device.

* * * * *